US009472869B2

(12) United States Patent
King, Jr. et al.

(10) Patent No.: US 9,472,869 B2
(45) Date of Patent: Oct. 18, 2016

(54) INSULATION DISPLACEMENT WIRE CONNECTORS

(71) Applicants: L. Herbert King, Jr., Wildwood, MO (US); James Keeven, O'Fallon, MO (US); Willaim Hiner, O'Fallon, MO (US)

(72) Inventors: L. Herbert King, Jr., Wildwood, MO (US); James Keeven, O'Fallon, MO (US); Willaim Hiner, O'Fallon, MO (US)

(73) Assignee: THE PATENT STORE LLC, O'Fallon, MO (US)

( * ) Notice: Subject to any disclaimer, the term of this patent is extended or adjusted under 35 U.S.C. 154(b) by 0 days.

(21) Appl. No.: 14/544,673

(22) Filed: Feb. 2, 2015

(65) Prior Publication Data

US 2015/0288078 A1 Oct. 8, 2015

Related U.S. Application Data

(60) Provisional application No. 61/995,181, filed on Apr. 4, 2014.

(51) Int. Cl.

| | |
|---|---|
| ***H01R 13/04*** | (2006.01) |
| ***H01R 11/20*** | (2006.01) |
| ***H01R 4/24*** | (2006.01) |
| *H01R 4/70* | (2006.01) |

(52) U.S. Cl.

CPC ..... *H01R 11/20* (2013.01); *H01R 4/2412* (2013.01); *H01R 4/2433* (2013.01); *H01R 4/70* (2013.01)

(58) Field of Classification Search

CPC .. H01R 11/20; H01R 4/2416; H01R 4/2433; H01R 4/2445; H01R 4/2454; H01R 4/2466; H01R 4/70; H01R 4/2404; H01R 4/4818; H01R 12/616; H01R 13/567; H01R 24/25; H01R 24/28

USPC ..... 439/694, 391, 395, 407, 409, 426, 439, 439/440, 443

See application file for complete search history.

(56) References Cited

U.S. PATENT DOCUMENTS

| | | | | |
|---|---|---|---|---|
| 5,435,747 | A * | 7/1995 | Franckx | H01R 4/2433 439/409 |
| 5,498,172 | A * | 3/1996 | Noda | H01R 12/616 439/404 |
| 7,918,684 | B2 * | 4/2011 | Lu | H01R 4/2433 439/395 |
| 2007/0066123 | A1 * | 3/2007 | Arlitt | H01R 4/24 439/409 |
| 2008/0081507 | A1 * | 4/2008 | Mahajan | H01R 4/2404 439/410 |
| 2010/0029129 | A1 * | 2/2010 | Cox | H01R 4/2433 439/405 |
| 2010/0068917 | A1 * | 3/2010 | Dennes | H01R 4/2433 439/409 |

* cited by examiner

*Primary Examiner* — Neil Abrams
*Assistant Examiner* — Travis Chambers
(74) *Attorney, Agent, or Firm* — Jacobson & Johnson LLC

(57) ABSTRACT

A field friendly wire connector for on-the-go connecting insulation coated electrical wires to each other without having to remove the wire insulation coating from either of the wires and without having to cut the wires with the wire connector including a flexible electrical conductor mounted in a connector base and a pair of slotted pivot arms sandwiching the flexible electrical conductor therein as the slotted pivot arms push the electrical wires into electrical contact with the electrical connector and a dual mode housing that forms a hand grip when attached to a first side of the connector base to provide a hand grip or support to the wire connector during formation of electrical connections and when the dual mode housing is attached to an opposite side of the connector base the dual mode housing forms a protective covering over the electrical connections.

20 Claims, 5 Drawing Sheets

INSULATION DISPLACEMENT WIRE CONNECTORS

CROSS REFERENCE TO RELATED APPLICATIONS

This application claims priority from U.S. provisional application Ser. No. 61/995,181 filed Apr. 4, 2014.

STATEMENT REGARDING FEDERALLY SPONSORED RESEARCH OR DEVELOPMENT

None

REFERENCE TO A MICROFICHE APPENDIX

None

BACKGROUND OF THE INVENTION

This invention relates generally to insulation displacement wire connectors and, more specifically, to wire connectors that allow one person to quickly connect two electrical wires to each other without the aid of tools and without having to cut or remove the insulation from either of the wires.

Although the wire connector may be used in many fields one of the fields that the invention is well suited for use is the tracer wire field since frequently branch wires are formed into electrical connection with a tracer wire. For example, the tracer wire field periodically requires one to form electrical branch connections to the tracer wire without cutting the tracer wire, which may follow an underground feature such as a pipeline. Examples of various types of tracer wire connectors can be found in U.S. Pat. No. 7,179,114; U.S. Pat. Nos. 8,637,774; 7,950,956; 7,093,858 and 7,179,114. Typically, to connect two wires together may require one hand to hold a set of wires in position for electrical engagement while also supporting one section of a two-part connector and with the other hand align a second section of the two-part connector with the first section of the two-part connector. Next, one engages the parts of the two-part connector to each other to form an electrical connection of the wires therein. Connections that require wire alignment before securement are typically best suited for two people since one person can hold the wires in position while the other person aligns the wires and engages the two parts of the two-part wire connector with each other.

SUMMARY OF THE INVENTION

A user-friendly wire two-stage wire connector for field use and on the go use to enable a person working alone to splice two insulation coated electrical wires to each other without having to remove the wire insulation coating from either of the wires, without the aid of tools and without having to cut the wires. The wire connector including a pair of opposed rotateable pivot arms that can be separately rotated from an open condition to a closed or locked condition as electrical wires with an insulation cover thereon are pushed between resilient tabs on an edge connector to simultaneously bring each of the electrical wires into electrical contact with the edge conductor and each other with a dual mode housing convertible from a wire connector hand grip to a protective cover over joined electrical wires.

DESCRIPTION OF THE PREFERRED EMBODIMENT

Figure 1:
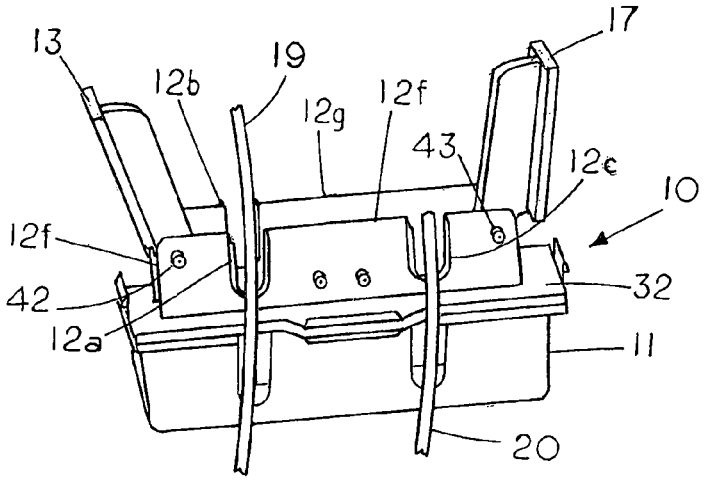
FIG. 1 is a pictorial view of an insulation displacement wire connector in an open condition.

FIG. 1 shows a two-stage hand held and hand operable insulation displacement wire connector 10 in an open position with the wire connector 10 carrying a dual mode housing 11 that is a cover in one mode and a hand handgrip in another mode. In the handgrip mode the housing 11 forms a handle for grasping and holding the wire connector 10 during a wire connection stage and in the cover mode the housing 11 covers the electrical connections in the wire connector. The housing 11 is removable from a stored condition as a handgrip on the bottom of wire connector base 32 after completion of electrical connections between two separate electrical wires. Once removed the housing 11 is attachable to the top of the wire connector base 32 as a protective cover for the joined electrical wires in the wire connector.

A feature of wire connector 10 is that no tools are required in forming electrical connections therein making it useful for a field technician to quickly join electrical wires to each other. A further feature is that one person can quickly and easily connect two wires together.

The dual mode housing 11 when used in the cover mode may contain a sealant 70 (FIG. 5) and can used to encapsulate and protect electrical junctions within the wire connector 10 after the formation of the electrical junctions in the wire connector. In the first stage one forms an electrical connection of insulation covered wire 19 to an internal conductor comprising a wire-engaging member 18 (FIG. 7) without cutting the wire 19 and without removing the insulation on the insulation covered wire 19. In the second stage one forms a second electrical connection to the same internal conductor 18 but at a different location on the internal conductor 18 also without removing the insulation covering on the wire 20, which allows a work person in the field and on-the-go to conveniently splice wire 20 to wire 19 since all the wire connector components, which are shown in FIG. 1, are held together as a unit during the two stage connection phase. Once the internal electrical connections are formed one can remove the dual mode housing 11, which is in the handgrip mode, from base 32 and encapsulate the electrical connector as shown in FIG. 2A as well as encapsulate the electrical junctions formed therein using only the parts in hand. In some cases a sealant 70 (FIG. 5) may be located in housing 11 thus enabling the waterproofing of the electrical connections by forcing the sealant around the wire connector as the dual mode housing 11 in the cover mode is attached to the top of the base 32.

The insulation displacement wire connector 10 includes an elongated base 32 with an elongated protective dual mode housing 11 temporarily and removeably stored on the underside of base 32 through a set of latches. Housing 11 is hand removable from the underside of base 32 and hand attachable to a top side of base 32 for on-the-go formation of an enclosure or cover to protect electrical connections formed to wire 19 and wire 20. That is, housing 11 includes latch hooks 11*j*, 11*k*, 11L and 11*m* for attachment to a first or underside of the base 32 when electrical connections are formed with the wire engaging member 18 with the housing 11 removable from the first side of the base 32 and attachable to an opposite side of the base 32 for encapsulation of the wire-engaging member 18 after an electrical connection has been formed therein with the housing side flaps 11*f*, 11*g*, 11*h*, 11*e*, 11*a*, 11*b*, 11*c* and 11*d* flexing to permit the first wire 19 and the second wire 20 to enter there between as the housing 11 is attached to the top side of the base 31 as shown in FIG. 2A.

In the example shown in FIG. 1 a first tee shaped wire pusher or pivot arm 17 is pivotally mounted on one end of base 32 and a second tee shaped wire pusher or pivot arm 13 is pivotally mounted on the other end of base 32 with operation of each pivot arm independent of the other. A first upright sidewall 12*f*, which is supported by base 32, is located on one side of arm 13 and arm 17 and a second upright sidewall 12*g*, which is also supported by base 32, is located on the opposite side of arm 13 and arm 17 with the side walls 12*f* and 12*g* supporting and shielding the wire pushers or pivot arms 17 and 13 when in a closed condition.

A first pivot pin 42 forms a first fulcrum that extends between the upright sidewall 12*g* and upright sidewall 12*f* and through an opening 13*m* (FIG. 3) in the end of pivot arm 13 to rotationally support pivot arm 13 thereon. A second pivot pin 43 forms a second fulcrum that extends between the upright sidewalls 12*g* and 12*f* and through an opening 17*m* (FIG. 3) in the end of pivot arm 13 to rotationally support pivot arm 17 thereon. Thus, a set of electrically insulating upright sidewalls 12*f* and 12*g*, which are spaced from each other, support a pair of spaced apart pivot arm fulcrums for pivotally and independently supporting pivot arms 13 and 17 as well as shielding connections and components between the sidewalls 12*f* and 12*g*. Examples of electrically insulating materials suitable for use in connector 10 are acrylonitrile butadiene styrene and polypropylene although other materials may be used without departing from the spirit and scope of the invention.

Wire connector 10 includes a first U-shaped top open wire cradle 12*a* on upright side 12*f* and a second U-shaped top open wire cradle 12*b* in upright side 12*g* that cradle and supports wire 19 which extends through the sides of the wire connector. On the opposite side of connector 10 a U-shaped top open wire cradle 12*c* cradles and supports wire 20 while upright sidewall 12*g* provides an end stop for the end of wire 20. Thus, during the field formation of an electrical connection between wires 19 and 20 the wire cradles 12*a*, 12*b* and 12*c* hold the wires in a position to facilitate electrical connection of the wires 19 and 20 to each other through an internal edge conductor 18, which is shown in isolated view in FIG. 7.

In the example shown in FIG. 1 the end of wire 20 is about to be connected or spliced to wire 19, which is uncut and extends through the sidewalls 12*g* and 12*f* of wire connector 10, however, it is envisioned that in some cases one may wish to connect two side by side wires to each other, both of which are uncut. In such a wire connector a further wire cradle may be formed in upright side 12*g*. Each of the wire cradles 12*c*, 12*a* and 12*b* provide support for a wire placed therein to limit downward penetration of the wires into the wire connector 10 as well as limit lateral motion of a wire therein prior to the wire brought into an electrical connection with internal edge conductor 18.

Figure 2:
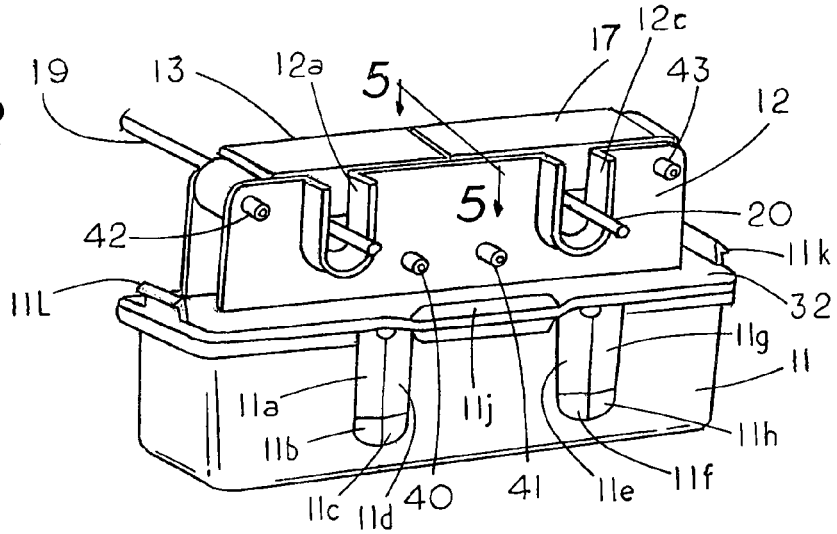
FIG. 2 is a pictorial view of the insulation displacement wire connector of FIG. 1 in a closed or wire connecting condition.
Figure 2A:
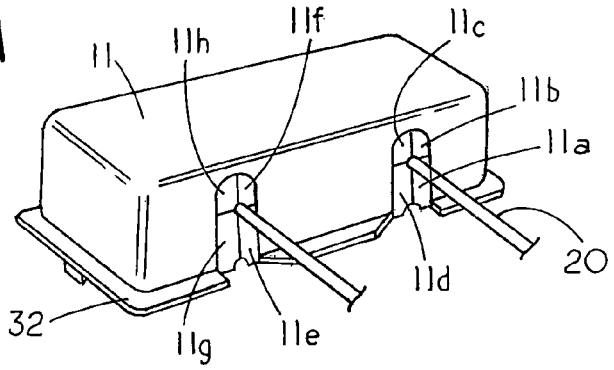
FIG. 2A is a pictorial view of the insulation wire connector of FIG. 1 in a closed condition.

FIG. 2 shows the two-stage insulation displacement connector 10 in a closed condition after formation of an electrical connection between electrical wire 19, which is supported in wire cradle 12*a* that is located in upright sidewall 12*f*, and a wire cradle 12*b*, which is located in upright side 12*g* (FIG. 1). An electrical wire 20, which is supported in wire cradle 12*c* is located in upright side 12*f*. The wire cradles allow one to quickly and properly position the wires 19 and 20 for forming an electrical connection as well as to hold the wires during and after the formation of an electrical connection between the two wires. A feature of the insulation displacement wire connector 10 is that wire 20 can be electrically connected to wire 19 without having to cut wire 19 or remove the insulation from either wire 19 or wire 20 through edge connector 18 (FIG. 3) that is located between upright side 12*f* and upright side 12*g*.

Housing 11, which is temporarily stored on the underside of base 32, includes a set of wire entry side flaps that permit the housing 11 to be placed around wires that are joined in base 32. That is, one side of housing includes wire entry side flaps 11*a*, 11*b*, 11*c* and 11*d*, which are each joined to housing 11 by an integral living hinge. Similarly, side flaps 11*e*, 11*f*, 11*h* and 11*g* are each joined to base 11 through an integral living hinge. A third set of identical side flaps are located on the opposite side of housing 11 to accommodate wire 19. The side flaps permit the housing 11 to extend around the wires as the housing/is placed on the topside of base 32 as a cover since the flaps flex on their living hinges to accommodate the wires 19 and 20, which are supported in connector 10 by base 32.

The housing 11 includes latch hooks 11*j*, 11*k*, 11L, 11*m* (FIG. 3) for attachment to a first side of the base 32 when electrical connections are formed with the wire engaging member with the housing 11 removable from the first side of the base and attachable to an opposite side of the base 32 for encapsulation of the wire-engaging member 18 after an electrical connection has been formed therein with the housing 11 including flexible side flaps that flex around the first wire and the second wire as the housing 11 is attached to a second side of the base to form a cover around the electrical wires extending through the housing 11.

Figure 3:
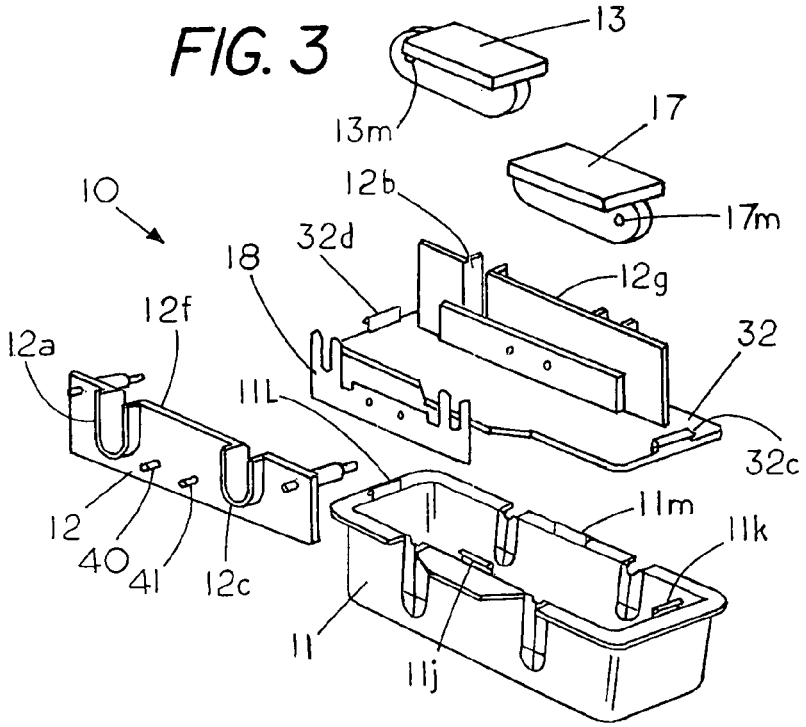
FIG. 3 is an exploded view of the insulation displacement wire connector of FIG. 1.

FIG. 3 shows an exploded view of the components of the insulation displacement connector 10 revealing a wire-engaging member 18 comprising an electrically conductive edge connector 18, which can be supported between upright sidewall 12*f* and upright sidewall 12*g* by pins 40 and 41. In this example the entire wire connector 10, with the exception of the edge connector 18, can be assembled from non-conductive electrical components through a set of pins 40 and 41 that extend through the electrically conductive edge connector 18.

Figure 4:
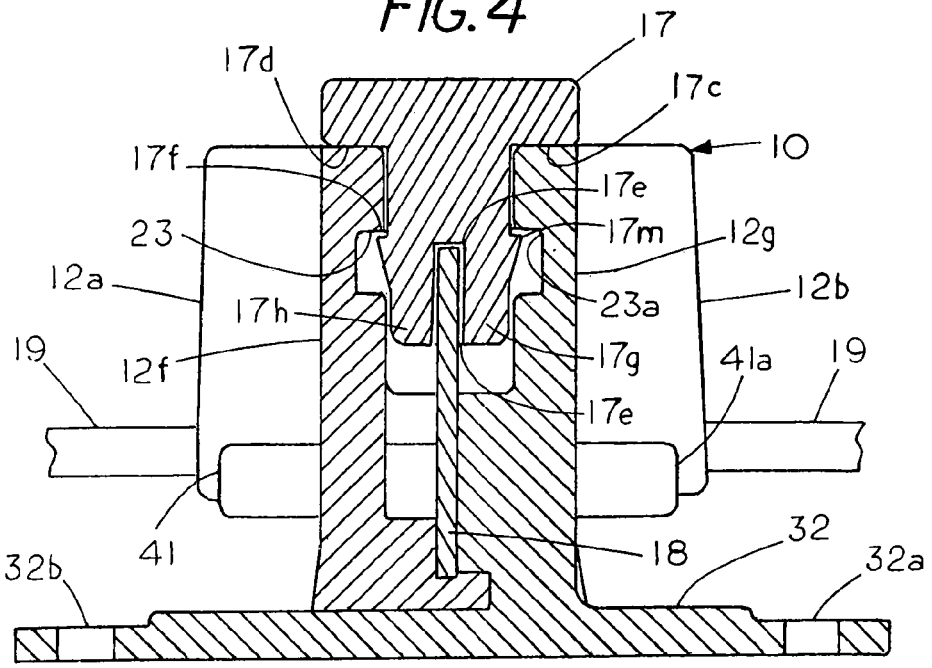
FIG. 4 is a sectional view of the insulation displacement wire connector of FIG. 1 with a1 taken along lines 5-5 of FIG. 2.
Figure 6:
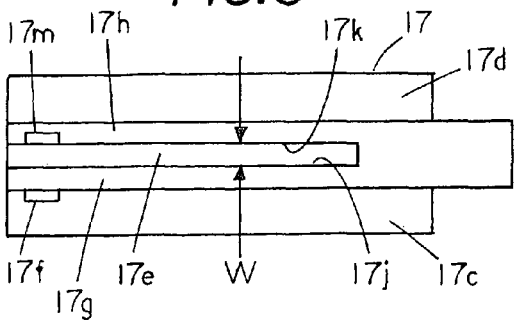
FIG. 6 is a bottom view of the pivotal arm of the insulation displacement wire connector of FIG. 3.

FIG. 4 is a cross sectional view taken along lines 5-5 of FIG. 2 revealing pivot arm 17 in a closed condition and having a first side lip 17*d* that rests on top of upright side 12*f* and a second side lip 17*c* that rests on top of upright side 12*g*. That is, upright side 12*f* and upright side 12*g* form a stop to limit rotating of pivot arm 17 and hence the penetration of the wire into the wire engaging member thus avoiding damaging the wire by limiting how far a wire can be forced into the wire engaging member 18. FIG. 4 also shows an end view of a slot 17*e* and FIG. 6 shows a bottom view of pivot arm 17 revealing the slot 17*e* of width W with slot 17*e* formed by web 17*h* and web 17*g* that extend partially along the underside of pivot arm 17. In this example a latch 17*m* on one side of pivot arm 17 and a latch 17*f* on the opposite side of pivot arm 17 provide for locking engagement of the pivot arm 17 with the upright sides 12*f* and 12*g* to thereby hold the pivot arm 17 in a locked or closed condition once the electrical connection has been formed between the wire edge connector 18 and the wires 19 and 20. This ensures that the electrical connection can be maintained. As can be seen in FIG. 4 the slotted pivot arm 17 sandwiches the flexible electrical conductor 18 therein as the slotted pivot arm 17 pushes the electrical wires into electrical contact with the electrical connector 18 to limit lateral displacement of the wire connector 18. Although not shown the pivoting of slotted pivot arm 13 also sandwiches the electrical connector 18 therein as the slotted pivot arm 13 also pushes the electrical wires into electrical contact with the electrical connector 18.

Figure 7:
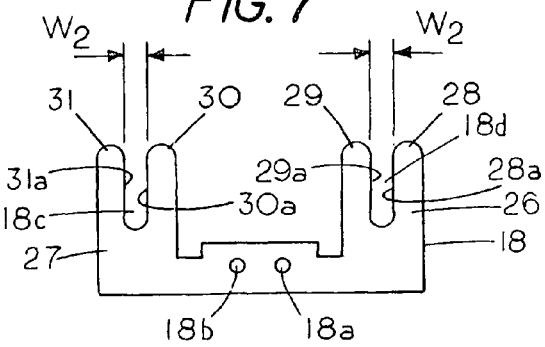
FIG. 7 is an isolated view of the edge connector of the insulation displacement wire connector of FIG. 3.
Figure 7A:
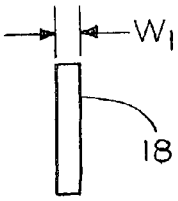
FIG. 7A is an end view of the edge connector of FIG. 7.

FIG. 6 and FIG. 7A show the width W of slot 17*e* as wider than the width $W_1$ of the edge connector 18 so that the edge connector 18 can be quickly aligned with the slot therein. The width W of slot in relation to the width $W_1$ of the edge conductor (FIG. 7A) is such that the slot sidewalls 17*k* and 17*j* allow free passage of edge connector 18 therein but inhibit the edge conductor 18 from bending as the sidewalls engage the wires being forced into tabs extending upward from the edge connector 18. In addition the pivot arm 17 facilitates alignment of the edge connector 18 with the slot 17*e* since the pivot arm rotates in a plane that extends through the edge connector 18. The pivot arm 13, which is located on the opposite end of housing 32, is identical and is not described herein. In the example shown two pivot arms are described, however, if desired a single pivot arm that can pushingly engage both of the electrical wires may be used to form an electrical connection of the wire engaging member 18 to the electrical wires located in the wire engaging member, however, two pivot arms are preferred since it is generally easier to make one connection at a time than two at once.

FIG. 4 reveals the engagement of a side hook or a side latch 17*f* on pivot arm 17 with a channel wall 23 in upright side 12*f* and the engagement of a side hook or side latch 17*m* on pivot arm 17 with a channel wall 23*a* on upright side 12*g*. In this example the resiliency of the electrical insulation material of pivot arm 17 and upright sides 12*f* and 12*g* allow a tapered face on each of the latches 17*f* and 17*m* to be forced between upright sides 12*f* and 12*g* until the latches are in locking engagement with the channel wall 23 and channel wall 23*a*, which retards or prevents withdrawal as an underside of hook 17*f* and an underside of hook 17*g* engage the respective channel wall 23*a* and 23. Consequently, once the electrical connection of the wire to connector 18 is formed one is assured that the wire will remain in contact with the wire connector 18.

As can be seen in FIG. 4 the edge connector slot 17*e* has a width wider that is wider than the width of the edge connector 18 to enable the edge connector 18 to easily fit into slot 17*e*. The purpose of pivot arm 17 is to smoothly and evenly force wire 20 down into the wire engaging edges 28*a* and 29*a* (FIG. 7) of edge connector 18 as the slot 17*e* extends on both sides of edge connector 19 to confine laterally movement of the edge connector.

Figure 10:
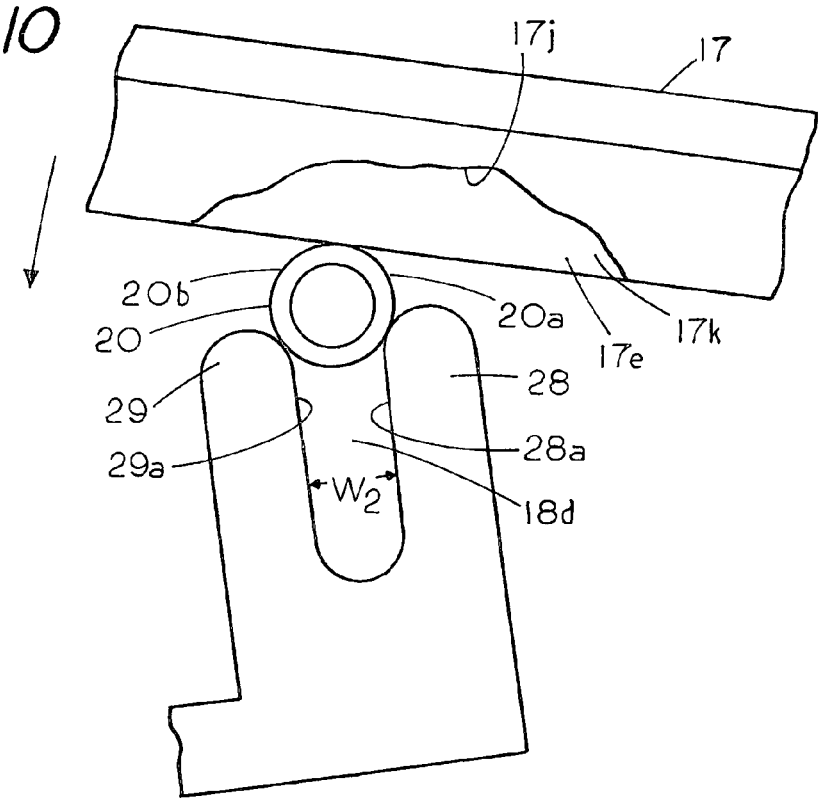
FIG. 10 is a partial sectional view of a wire in a position to form an electrical connection therewith.
Figure 11:
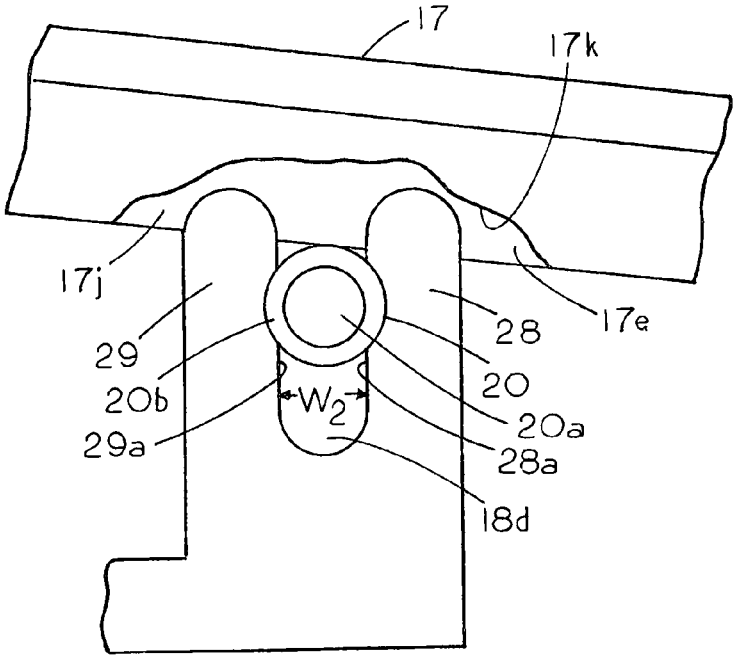
FIG. 11 is a partial sectional view of a wire in electrical engagement with lateral side tabs of an edge connector.

FIG. 10 is a partial view that shows that the continued pivoting of pivot arm 17 forces the insulation covered wire 20 into the gap 18*d* in edge connector 18 as blunt edges 28*a* and 29*a* of the edge connector 18 are brought into sliding and insulation piercing engagement with the insulation covered wire 20 while FIG. 11 shows that the continuing pivoting of arm 17 forces wire 20 between tabs 28 and 29 in a continued sliding and insulation piercing engagement to locally remove the flexible wire insulation cover 20*b* while simultaneously forming electrical contact between the tabs 28 and 29 of edge connector 18 and the wire 20. Once the pivot arm 17 is engaged the latch 17*f* and latch 17*g* (FIG. 4) the wire 20 is held in position to prevent accidental rotation or release of pivot arm 17 thereby ensuring that the wire 20 held in edge connector 18 remains in position to maintain the wire 20 in electrical contact with the edge connector 18. Although not shown the pivot arm 13 operates in an identical manner as wire 19 is formed into electrical contact with edge of tab 30 and edge of tab 31, which are on the opposite end of the edge connector 18.

Thus, the invention provides a method of independently forming an electrical connection between two wires 19 and 20 without removing the electrical insulation from either and without having to cut the two wires by forcing a first electrical conducting wire 19 between a first set of tabs 30, 31 (FIG. 7) on an edge connector 18 wherein the first set of tabs form an interference fit with the first electrical conducting wire 19 to establish an electrical connection to the edge connector 18 and forcing a second electrical conducting wire 20 between a second set of tabs 28, 29 (FIG. 7) on the edge connector 18 wherein the second set of tabs form an interference fit with the second electrical conducting wire 20 to establish an electrical connection between the first electrical wire 19 and the second electrical conducting wire 20 through the edge connector 18.

FIG. 7 shows an isolated front view of a one-piece edge connector 18 for establishing electrical contact with covered electrical wires through penetration of the layer of insulation on the exterior of an electrical wire while FIG. 7A shows an isolated end view of edge connector 18. Typically, edge connector 18 may be made from a thin strip of copper alloy, which in addition to having good electrically conductivity also provides both stiffness and resiliency to support cantilevered tabs formed in the edge connector 18. However, other materials may be used without departing from the spirit and scope of the invention.

In the example shown the edge connector 18 includes a first cantilevered wire-engaging member 27 having a first cantilevered tab 31 and a second cantilevered tab 30 with a wire-receiving slot 18*c* of width $W_2$ formed by a first edge 31*a* and a second edge 30*a*, which are spaced from each other in a face to face relationship, with each of the tabs having a rounded end surface that converges to a wire receiving slot 18*c* between the tabs. Edge connector 18 also includes a second cantilevered wire-engaging member 26 having a first cantilevered tab 29 and a second cantilevered tab 28 with a wire-receiving slot 18*d* of width $W_2$ formed by a first edge 29*a* and a second edge 28*a*, which are spaced from each other in a face to face relationship, with each of the tabs 29, 28 having a rounded end surface that converges to a wire receiving slot 18*d* between the tabs.

A set of holes 18*a* and 18*b* permit the edge connector 18 to be mounted in base 32 by clamping the edge connector between upright member 12*f* and 12*g* through fasteners 40 and 41. (FIG. 1)

Figure 9:
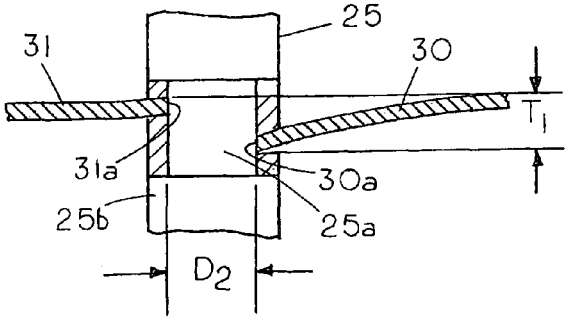
FIG. 9 is an isolated view partially in section of the edge connector of FIG. 7 in engagement with a second larger wire.
Figure 9A:
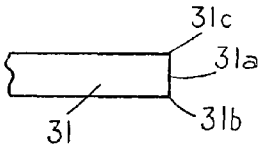
FIG. 9A is an isolated view of the blunt face of the edge connector of FIG. 7.

FIG. 9A shows an isolated partial top view of tab 31 of a portion of the edge connector 18 revealing a blunt edge 31*a* and an angled corner 31*b* and an angled corner 31*c*. In operation the blunt edge 31*a* can remove insulation and form an electrical face-to-face connection to a wire as it is forced between the tabs. The blunt edge has the benefit of lessening the chances of cutting the wire that may occur if the edge has a v shaped blade, however, in some applications where harm to the wire would be minimal one may use a v-shaped blade. The other edges are identical and are not described herein.

A feature of the invention is that the wire connector 10 can receive and form electrical connections to a range of different size wires. For example, wire gauges 12AWG and 14AWG may be formed into electrical engagement with slot widths $W_2$ of the same size. In the event the wire is oversized the flexibility of edge connector 18 accommodates the oversized wire through a deflection of the tabs as shown in FIG. 9, which causes the rigid angled corners of blunt edge 31*a* to bite into the electrical wire core 25*a*. Thus, with edge connector 18 either the face 31*a* or the angled corners 31*c* or 31*b* or both of the cantilevered tab 31 engage one side of the wire and the corresponding face and angled corners of tab 30 similarly can engage the opposite side to form an electrical connection. The wire connector 10 being able to connect electrical wires of different diameters without changing the spacing between tabs since the flexing of the tabs of the edge connector 18 are used to form electrical connections when the wires are of different sizes.

FIG. 10 shows that in operation of connector 10 a wire 20 is first placed between the rounded top of tabs 29 and 28. Next, one pivots pivot arm 17 to force the wire downward into the slot 18*d* between the tabs 29 and 28 where the edges 29*a* and 28*a* pierce the insulation to make contact with the electrical wire 20*a* therein. Similarly, a second wire 19 is first placed between the top of tabs 31 and 30 and one pivots pivot arm 13 to force the wire 19 downward into the slot 18*c* between the tabs 30 and 31 where the rigid blunt wire engaging edge 30*a* and the rigid blunt wire engaging edge 31*a* pierce the insulation to make contact with the electrical wire therein. Thus, a first pivot arm 17 forces a first wire 20 into electrical contact with the blunt edges 28*a* and 29*a* of the first set of tabs 28 and 29 and similarly a second pivot arm 13 forces a second wire 19 into electrical contact with the blunt edges of the second set of rigid wire engaging edges 30*a* and 31*a* on tabs 30 and 31 whereby the electrical contact of the first wire with the first set of tabs and the electrical contact of the second wire with the second set of tabs forms an electrical path between the first wire and the second wire through the edge connector 18.

The width $W_2$ between tabs 30 and 31 as well as the width $W_2$ between tabs 28 and 29 is an interference fit with the electrically conducting core of each of the wires inserted therein. The interference fit of tabs 30 and 31 causes the rigid edges 30*a* and 31*a* to penetrate through the insulation covering on the wire therebetween as the wire connector edges 30*a* and 31 are brought into electrical contact with the electrically conducting wire core of the wire. Similarly, the interference fit of tabs 29 and 28 with a wire core therebetween causes the wire connector edges 30*a* and 31*a* to penetrate through the insulation covering 20*b* on the wire 20 as the rigid edges 29*a* and 28*a* are brought into electrical contact with the electrically conducting wire core of the wire.

Figure 8:
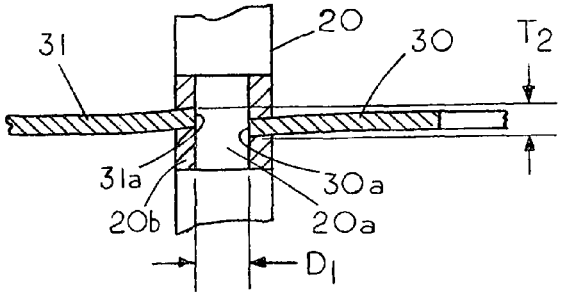
FIG. 8 is an isolated view partially in section of the edge connector of FIG. 7 in engagement with a wire of a first size.

To appreciate edge 30*a* and edge 31 engagement with an electrically conductive wire core reference should be made to FIG. 8, which shows wire 20 having an electrically conducting core 20*a* and a soft flexible outer insulation cover 20*b*. In the example shown wire 20 has been forced between tabs 31 and 30 causing the wire edges 30*a* and 31*a* to penetrate the insulation covering 20*b* to make electrical contact with the electrical conductive wire core 20*a*. Similarly, wire 19 can be formed into electrical contact with tabs 28 and 29 through engagement of edges 28*a* and 29*a*, which engage the electrical wire core therein.

FIG. 10 and FIG. 11 are isolated views showing the formation of an electrical connection with wire 20, which has an eclectically conducting core 20*a* and a soft, flexible, annular, outer insulation covering 20*b*. FIG. 10 shows the wire 20 supported on the rounded ends of tabs 28 and 29 since the diameter of the wire 20 is greater than the slot width $W_2$. The pivot arm 17 with slot 17*e* is shown partially in section and in position to push or force the wire 20 between the tabs 28 and 29. In this example the rounded ends act as a funnel or guide to direct the wire 20 into the slot 18*d* between tabs 28 and 29 as the pivot arm 17 is rotated. As the wire 20 is forced between the tabs 28 and 29 the blunt edges 28*a* and 29*a* penetrate the soft, flexible, outer insulation cover 20*b* until the blunt edges 28*a* and 29*a* engage the wire connector 20*a* because of an interference fit between the gap $W_2$ of the tabs 28 and 29 and the diameter of core 20*a*. The interference fit causes the tabs to yield slightly along a plane extending through the tabs as the wire is forced between the tabs. The spreading of the tabs along a plane through the tabs creates a compressive force on the wire to maintain the edges of the tabs in electrical contact with the wire 20. However, if the interference is to great tabs may be spread beyond a yield point and thus may not maintain itself in electrical contact with the wire. A feature of the invention is that a portion of a spreading force can be used to laterally deflect the tabs without exceeding the yield point of the material and thus allow more than one size wire to be connected in the wire connector. Thus a feature of the invention is the wire-engaging member 18 comprises a rigid but laterally resilient member that enables on-the-go connection to a pair of electrical wires as illustrated in FIGS. 8-11.

FIG. 11 shows the pivot arm 17 after the pivot arm has been rotated sufficiently to force wire 20 into the slot 18*d* between tabs 28 and 29. In this condition the edges 28*a* and 29*a* have pierced the insulation covering 20 and are in contact or electrical engagement with the electrical conducting core 20*a*. In addition the end of tab 28 and the end of tab 29 are located within slot 17*e* and are laterally confined by the sidewall 17*j* and sidewall 17*k* to prevent the tabs 28 or 29 from folding over if the diameter of the wire is sufficiently larger than the width $W_2$ between the wires. Similarly, pivot arm 13 includes identical sidewalls to prevent the tabs 30 or 31 from folding over if the diameter of the wire is sufficiently larger than the width $W_2$ between the wires, A feature of the wire connector 10 is that the edge connector 18 can form electrical connections with wires of different sizes through a flexing action of the tabs of the edge connector 18. To illustrate this feature FIG. 8 shows a sectional view at the points of contact of a wire 20 with the tabs 30 and 31 and FIG. 9 shows a sectional view of the points of contact of a larger wire 25 with the tabs 30 and 31.

FIG. 9 shows wire 25 having an electrical conductive core 25*a* and a soft flexible outer insulation cover 25*b* with the wire edge 31*a* in engagement with one side of wire 25 and wire edge 30*a* in engagement with the opposite side of wire 25. The distance between the tabs in the unengaged condition is $W_2$ as shown in FIG. 7, however, in the engaged condition shown in FIG. 9 the wire edges 31*a* and 30*a* have been forced apart axially and laterally to accommodate the larger diameter $D_2$ of wire 25 through a lateral flexing of the tabs 30 and 31, which is revealed by the distance $T_1$ that indicates the flexing of the tabs at the points of contact of the tabs in response to the wire 25 being forced therebetween. In contrast, as shown in FIG. 8 the smaller wire 20 which is in engagement with the tabs 30 and 31 produces less flexing of the tabs as indicate by the dimension $T_2$, which is less than the dimension $T_1$. However, in both cases an electrical connection to the tabs 30 and 31 has been formed. With the larger wire 25 the confinement of the side walls of 17*k* and 17*j* of the pivot arm with the cantilever ends of tabs 29 and 30 can maintain the tabs 29 and 30 in position to penetrate the insulation and make electrical contact with the wire core 25*a* even though the tabs may flex at the point of contact with the electrical wire. Thus, a feature of the invention is that the wire connector 10 can accommodate a range of wire sizes through the resiliency of flexible tabs 29 and 30, which can redirect a portion of a tab spreading force to laterally deflect the tabs in response to the larger diameter wire in engagement with the wire core. For example, with copper alloy tabs having a thickness $W_1$ of 0.032 inches and a width $W_2$ one can connect a wire 20 such as shown in FIG. 8 that forms an interference fit 0.008 inches between the wire and the edges of the edge connector or one can connect a wire 25 that forms an interference fit of 0.025 inches between the wire and the edges of the edge connector. In either case one can obtain a good electrical connection. The example provided herein is to illustrate the ability of the tabs of the same width to electrically engage wires of different size although no limitation to dimensions or materials is intended. The feature of the laterally deflection of the tabs as well as the spreading of the tabs allows the spreadable tabs to form an interference fit with different size wires while at the same time the material of the tabs is not stressed beyond the yield point of the material.

Figure 5:
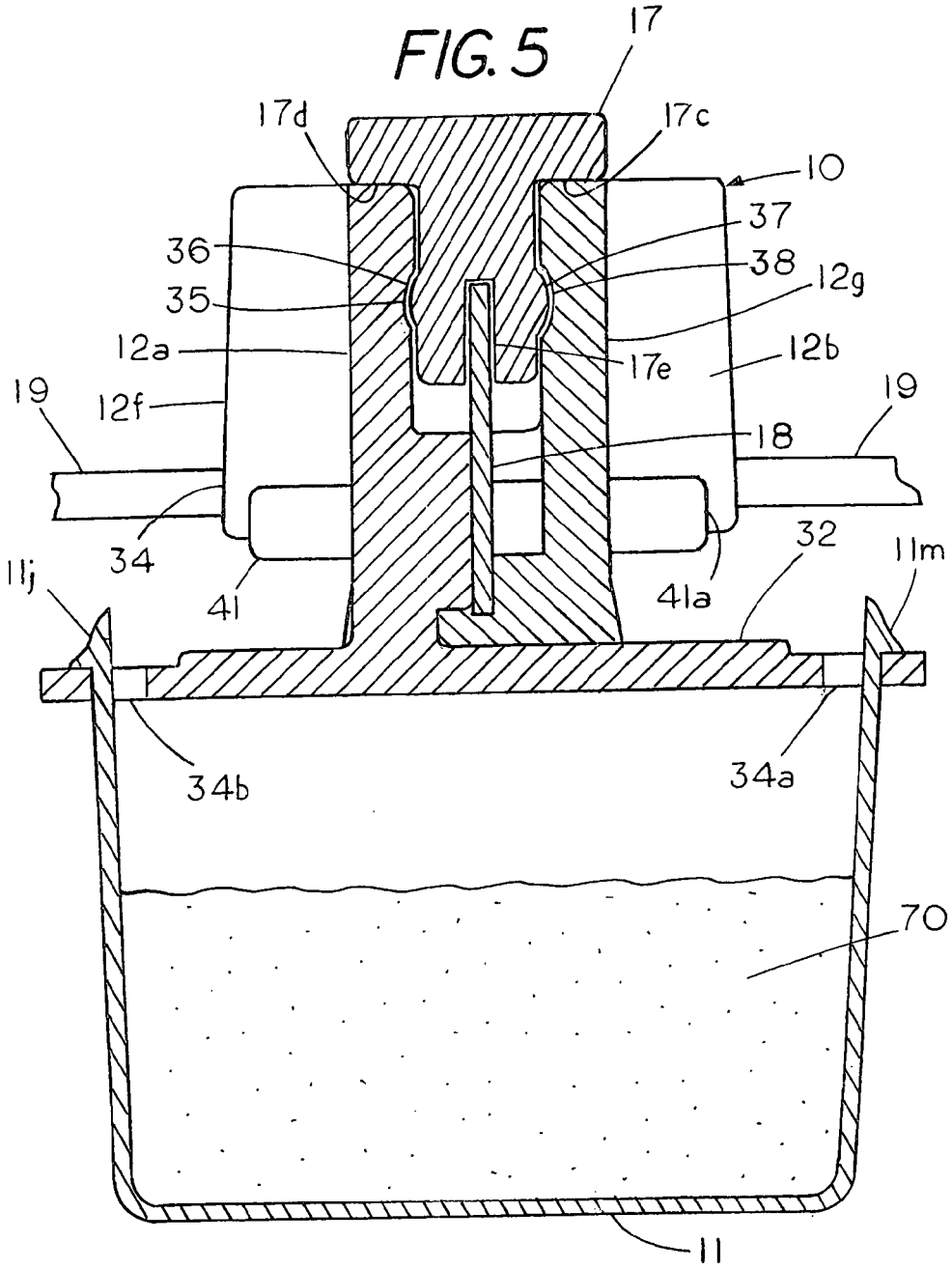
FIG. 5 is a sectional view of an alternate embodiment of an insulation displacement wire connector with an alternate latching mechanism.

Once the wire edge connector 18 engages the wire the pivot arm 17 is latched to maintain the pivot arm and hence the wire in position against the edge connector. A reference to FIG. 4 shows a latch comprising hooks 17*f* and 17*m* while a reference to FIG. 5 shows a latch on arm 17 formed by a dimple 35 in upright 12*a* and protrusion 36 on one side of lever 17 and a dimple 38 in upright 12*g* and a protrusion 37 on one side of lever arm 17. In the latched position as shown in FIG. 5 the lever arm is maintained in position thereby ensuring that the wire located in the edge connector 18 is maintained in the edge connector 18. In this example the ledge 17*c* of pivot arm 17 engages the top of upright 12*g* and ledge 17*d* engage the top of upright 12*a* as the dimples and protrusions secure the pivot arm in position while in the example of FIG. 4 the hook 17*f* engages the channel wall 23 and the hook 17*m* engages the channel wall 23*a* to hold the pivot arm in position.

FIG. 5 shows the hand attachable housing 11 in section with end fasteners for latching the housing 11 to either the top or the bottom of base 32. Housing 11 includes a cantilevered latch hook 11*j* having a tapered face on one side and a cantilevered latch hook 11*m* having a tapered face on the opposite side with hook 11*j* extending through opening 34*b* to engage base 32 and hook 11*m* extending through hook 34*a* to engage base 32 to removable store the housing 11 as a handgrip on the underside of base 32 as wires are being connected to each other through the wire engaging member 10. By squeezing the sides of housing 11 the fastener comprising latch hook 11*j* and the fastener comprising latch hook 11L can be forced inward toward each other from housing 11 allowing one to remove housing 11 from the underside of base 32. Once removed the housing 11 which can function either as a cover or handgrip can be reversed and placed on the top of wire connector 10 with the latches 11*j* and 11*m* of the housing 11 engaging the base 32 from the top side to thereby form a protective cover over the wire connector 10. That is, by engaging latch hook 11*j* and latch hooks 11*m* from the topside of base 32 rather than the underside of the base one can form a protective cover over the electrical connections therein.

FIG. 3 illustrates that the ends of housing 11 may include latch 11L and 11*k* that fastened in an identical manner to latch 11*j* and latch 11*m*. Thus, the fasteners or latches comprising hooks 11*k* and 11L on the end of housing 11 (FIG. 3) can similarly be engaged with openings 32*d* and 32*c* in base 32 from either the top side of base 32 or the bottom side of base 32.

We claim:

1. A wire connector comprising:

an elongated base;

an electrically conductive wire-engaging member extending along the elongated base with the wire-engaging member having a first set of resilient wire engagement tabs cantilevered therefrom with a first wire receiving slot therebetween and a second set of resilient wire engagement tabs cantilevered therefrom with a second wire receiving slot therebetween with each of the wire engagement tabs flexing in response to insertion of an insulation covered wire therebetween;

a first wire cradle for holding a first insulation covered wire in position for sliding into insulation piercing engagement with the first set of resilient wire engaging tabs;

a second wire cradle for holding a second insulation covered wire in position for sliding into insulation piercing engagement with the second set of resilient wire engaging tabs;

a first edge and a second edge on said first set of wire engagement tabs;

a first edge and a second edge on said second set of wire engagement tabs;

a first pivot arm pivotally mounted on one end of said base, said first pivot arm having a slot aligned with said first set of tabs for receiving the first set of wire engaging tabs as the first pivot arm pivots and forces a first wire into electrical contact with the first edge and the second edge of the first set of tabs as the tabs extend into the slot of the first pivot arm;

a second pivot arm spaced from said first pivot arm and in axial alignment with said first pivot arm, said second pivot arm having a slot aligned with said second set of tabs as the second pivot arm pivots and forces a second wire into electrical contact with the first edge and the second edge of the second set of wire engagement tabs, said second set of tabs extending into the slot in the second pivot arm, the electrical contact of the first wire with the first set of wire engagement tabs and the second wire with the second set of wire engagement tabs forming an electrical path between the first wire and the second wire as the first edge and the second edge of the first set of wire engagement tabs flex to bring the first insulation covered wire into contact therewith and the first edge and the second edge of the second set of wire engagement tabs flex to bring the second insulation covered wire into contact therewith; and a dual mode housing providing a handgrip when attached to a first side of the base and a cover when attached to the opposite side of the base.

2. The wire connector of claim 1 wherein the first edge and the second edge on the first set of tabs engages opposite sides of the first wire and the first edge and the second edge on the second wire engagement tabs engages opposites sides of the second wire.

3. The wire connector of claim 1 wherein the wire engaging member comprises an edge connector with the first set of tabs cantilevered from the edge connector and the second set of tabs cantilevered from the edge connector wherein the first set of cantilevered tabs are resiliently and laterally deformable to accommodate the first electrical wire and the second set of cantilevered tabs are resiliently and laterally deformable to accommodate the second electrical wire where the second electrical wire is larger than the first electrical wire.

4. The wire connector of claim 1 including the dual mode housing includes latch hooks for attachment to a first side of the base as a handgrip when electrical connections are formed to the wire engaging member, said housing removable from the first side of the base and attachable to an opposite of the base as a cover for encapsulation of the wire-engaging member after an electrical connection has been formed therein with the housing including side flaps, said side flaps flexing to permit the first wire and the second to enter there between as the cover is attached to a second side of the base.

5. The wire connector of claim 1 wherein the wire connector is a tracer wire connector and the wire connector includes a set of wire cradles for supporting an uncut wire and at least one wire cradle for supporting a wire to be joined to the uncut wire.

6. The wire connector of claim 1 wherein an end of each of the first set of wire engagement tabs is restrained from lateral movement by a pair of sidewalls in the first pivot arm and the end of each of the second set of wire engagement tabs is restrained from lateral movement by a pair of sidewalls in the second pivot arm.

7. The wire connector of claim 1 wherein the first pivot arm includes a latch for securing the first pivot arm to the base.

8. The wire connector of claim 7 wherein the latch comprises a hook for engaging a channel wall supported by said base.

9. The wire connector of claim 7 wherein the latch comprises a protrusion for engaging a first dimple to retard or prevent rotation of the first pivot arm.

10. A wire connector for forming an electrical path between two wires of equal or different size comprising:

an electrically conductive wire engaging member;

a member for forcing a first insulation covered wire into the first set of rigid wire engaging edges;

a further member for forcing a second insulation covered wire into the second set of rigid wire engaging edges;

a base supporting said electrically conductive wire engaging member with said electrically conductive wire engaging member including a first laterally flexible tab having a first rigid wire engaging edge and a second laterally flexible tab having a second rigid wire engaging edge with the first laterally flexible tab and the second laterally flexible tab flexing laterally to accommodate a larger diameter wire by redirecting a portion of a tab spreading force to laterally deflect the first laterally flexible and the second laterally tab wherein a first wire located in the first set of rigid wire engaging edges and a second wire located in the second set of rigid wire engaging edges are in electrically communication with each other through the electrically conductive wire engaging member.

11. The wire connector of claim 10 wherein the wire-engaging member comprises a rigid but laterally resilient member having a pair of blunt edges for piercing an insulation covering on an electrical wire in order to contact an electrical wire core therein.

12. The wire connector of claim 10 including a set of electrically insulating upright members spaced from each other, said upright members forming a pivot arm fulcrum for pivotally a supporting a pivot arm thereon.

13. The wire connector of claim 10 wherein the member comprises a first pivot arm for maintaining the first wire in electrical engagement with the first set of rigid wire engaging edges and the further member comprises a second pivot arm for maintaining the second wire in electrical engagement with the second set of rigid wire engaging edges.

14. The wire connector of claim 13 said housing comprises an electrical insulation material mode housing attachable to either side of the base.

15. A method of forming an electrical connection between two wires without removing the electrical insulation from either and without having to cut the two wires comprising;

forcing a first electrical conducting wire between a first set of tabs on an edge connector with the first set of tabs flexing laterally to accommodate a larger diameter wire by redirecting a portion of a tab spreading force to laterally deflect a first laterally flexible tab and a second laterally tab in the first set of tabs wherein the first set of tabs form an interference fit with the first electrical conducting wire to establish an electrical connection to the edge connector; and forcing a second electrical conducting wire between a second set of tabs on the edge connector with the second set of tabs flexing laterally to accommodate a larger diameter wire by redirecting a portion of a tab spreading force to laterally deflect a first laterally flexible tab and a second laterally tab in the second set of tabs wherein the second set of tabs form an interference fit with the second electrical conducting wire to establish an electrical connection between the first electrical wire and the second electrical conducting wire while holding the first wire in contact with the first set of tabs and the second wire in contact with the second set of tabs.

16. The method of claim 15 including the step of pivoting a slot in a first pivot arm around the first set of tabs to force the first electrical conducting wire between the first set of tabs and pivoting a slot in the second pivot arm around the second set of tabs to force second electrical conducting wire between the second set of tabs wherein each of the set of tabs has a blunt edge for piercing through an electrically conducting insulation covering.

17. The method of claim 15 including the step of forcing the first electrical conducting wire comprises laterally deflecting the first set of tabs.

18. The method of claim 15 including the step of placing a first electrically conducting wire comprise placing an electrically conducting wire with an insulation covering thereon and piercing through the insulation with a blunt edge on the first set of tabs and placing a second electrically conducting wire comprise placing an electrically conducting wire with an insulation covering thereon and piercing through the insulation with a blunt edge on the second set of tabs.

19. The method of claim 15 including the step of laterally confining an end of the first set of tabs as the first wires is forced between the first set of tabs.

20. The method of claim 15 including the step of forcing a wire of first diameter between the first set of tabs and a second wire of a larger diameter between the second set of tabs wherein the width of the slot between the first set of tabs and the width of the slot in the second set of tabs is the same.

* * * * *